US006484640B1

(12) United States Patent
Schneider et al.

(10) Patent No.: US 6,484,640 B1
(45) Date of Patent: Nov. 26, 2002

(54) METHOD OF PRODUCING A SCREENING SMOKE WITH ONE-WAY TRANSPARENCY IN THE INFRARED SPECTRUM

(75) Inventors: Josef Schneider, Kirchheim (DE); Ernst-Christian Koch, Kaiserslautern (DE); Axel Dochnahl, Ramstein (DE)

(73) Assignee: Pepete GmbH, Hanau (DE)

( * ) Notice: Subject to any disclaimer, the term of this patent is extended or adjusted under 35 U.S.C. 154(b) by 0 days.

(21) Appl. No.: 09/937,615

(22) PCT Filed: Jan. 7, 2000

(86) PCT No.: PCT/EP00/00062

§ 371 (c)(1),
(2), (4) Date: Sep. 27, 2001

(87) PCT Pub. No.: WO00/58239

PCT Pub. Date: Oct. 5, 2000

(30) Foreign Application Priority Data

Mar. 27, 1999 (DE) ..... 199 14 033

(51) Int. Cl.[7] ..... C06D 3/00
(52) U.S. Cl. ..... 102/334; 102/336; 102/505
(58) Field of Search ..... 102/334, 336, 102/505

(56) References Cited

U.S. PATENT DOCUMENTS 4,406,815 A * 9/1983 Magnusson et al. .... 102/334 X
4,621,579 A * 11/1986 Badura et al. ..... 102/334
4,704,966 A * 11/1987 Sellman et al. ..... 102/505 X
4,704,967 A * 11/1987 Milstead et al. ..... 102/334
5,025,729 A * 6/1991 Cameron ..... 102/505 X
5,148,173 A * 9/1992 Rouse et al. ..... 102/505 X
5,317,163 A * 5/1994 Obkircher ..... 102/334 X
5,389,308 A 2/1995 Busel et al. ..... 252/587
5,587,552 A * 12/1996 Dillehay et al. ..... 102/336 X
5,656,794 A 8/1997 Krone et al. ..... 149/108.2
5,679,921 A * 10/1997 Hahn et al. ..... 102/336 X
5,682,010 A 10/1997 Embury, Jr. ..... 102/334
6,013,144 A * 1/2000 Callaway ..... 102/336 X
6,047,644 A * 4/2000 Malecki et al. ..... 102/505 X
6,190,475 B1 * 2/2001 Nielson ..... 102/336 X

FOREIGN PATENT DOCUMENTS

| | | |
|---|---|---|
| DE | 40 30 430 | 12/1993 |
| DE | 43 37 071 | 3/1995 |
| DE | 196 01 506 | 7/1997 |
| EP | 0 106 334 | 1/1989 |

* cited by examiner

*Primary Examiner*—Peter A. Nelson
(74) *Attorney, Agent, or Firm*—Foley & Lardner

(57) ABSTRACT

The invention relates to a method of producing a screening smoke which is one-way transparent in the infrared spectrum (780 nm–14.0 μm) and opaque in the visible spectrum. According to the invention a known pyrotechnic screening smoke which is highly absorbent in the visible spectrum (380 nm–780 nm) is generated in the form of an aerosol, pyrotechnic scattered particles between 10 and 100 μm in size are simultaneously produced in said aerosol, and the resulting two-component smoke is irradiated by an infrared radiation source (spectrum: 780 nm–14.0 μm) from the smoke producer side.

5 Claims, 2 Drawing Sheets

Figure 1:
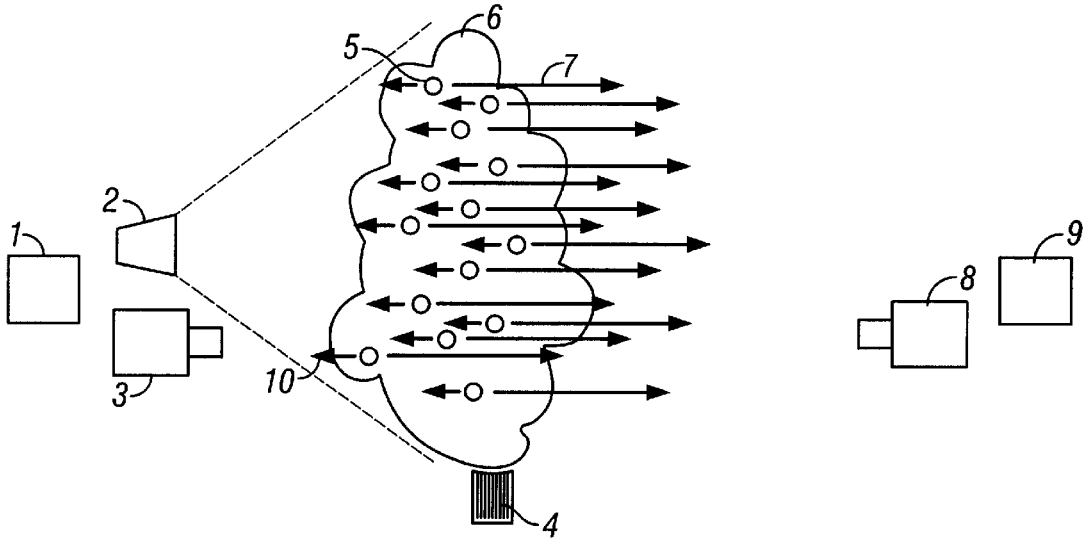

METHOD OF PRODUCING A SCREENING SMOKE WITH ONE-WAY TRANSPARENCY IN THE INFRARED SPECTRUM

The subject of the present invention is a process for the production of a screen smoke one-sidedly transparent in the infrared spectral range, whereby scattered particles of suitable size introduced into an aerosol are impinged against by means of infrared radiation so that there is given a strongly marked forwards scattering on the scattered particles. The aerosol itself consist of known screen smoke strongly absorbing in the visible range.

In the case of military deployment and also in the case of police deployment against barricaded prepetrators, is of considrable advantage when, for a short time, ones own change of position cannot be observed by the opponents. Since today an observation takes place not only in the visible range but also via IR and radar technology, in the past smoke-producing mixtures have been developed to a large extent which are brought as thrown bodies between ones own position and that of the opponent and there produce a local wall of smoke which slowly breaks up in the air or is driven away by the wind or are burnt in so-called smoke pots, whereupon the smoke cloud produced is spread out with the wind between ones own position and the position of the opponents (cf. EP 0 106 334 A2, DE 43 37 071 C1, DE 40 30 430 C1). Although such smoke screens give a very good protection not only in the visual but also in the infrared spectral range, they have the disadvantage that during the time in which the smoke is impenetrable (usually about 20–60 seconds), not only the smoke producer but also the opponent can change the position so that for a subsequent use not only the opponent must again ascertain his own position but one must oneself again also ascertain the position of the opponent. The smoke producer would, therefore, have a considerable tactical advantage when, during the effective phase of the artifical smoke, he could admittedly camouflage his own actions but, at the same time, could also follow the actions of the opponent and react thereon.

Therefore, the task forming the basis of the invention is to develop a one-sidedly transparent screen smoke.

The known screen smokes usually consist of aerosols of solid and liquid particles, whereby the size of the individual particles lie in the order of magnitude of the wavelength of the radiation to be weakened so that they are suitable for a scattering and absorption of the light.

From U.S. Pat. No. 5,682,010 is known a one-sided camouflage action in the visual range in the case of which such a mist cloud containing an absorbing aerosol is simultaneously produced with an aerosol cloud of particles which do not absorb the light but merely scatter, whereby the absorbing cloud in closer to ones own position and the scattering cloud to that of the opponent. In this way, the light coming from the opponent is less weakened than the light from ones own object observable by the opponent so that, in all, a residual light can be observed sufficient for the ascertainment of the opponent's position. Insofar as both mist clouds mix with one another, the effects for both sides are the same so that the above advantage is lost. It is a disadvantage of this device that the simultaneous production of the two mist clouds at definite intervals from one another and to the discharge and target is difficult and, due to different local wind influences, the mist clouds are also additionally displaced against one another. Therefore, this manner of procedure is not suitable for practical use.

According to DE 196 01 506 A1, a one-sidedly permeable sight barrier is thereby achieved in that one brings to shining a per se transparent artificial mist, consisting of aerosol particles or gases, by radiation with electromagnetic radiation of appropriate wavelength (fluorescence, Raman scattering, diffuse reflection). Since this lighting up is an isotropic effect, i.e. also takes place on the side of the mist producer, a pulsed radiation source is used, the impulse frequency of which is adapted to the period of time of the emission effects.

By means of a closure, the detector of the mist user is shut off during the radiation time go that only electromagnetic radiation is detected in the radiation pauses. The radiation frequency is typically so high that the opponent sees a continuously emitting mist cloud. In order to prevent countermeasures of the opponent, the impulse sequence of the radiation source is modulated by an algorithm not known to the opponent. The disadvantages of this process are, on the one hand, the devices necessary for the laborious, expensive and susceptible exciting and detection process and, on the other hand, the toxicologically hazardous fluorescing substances in the mist cloud necessary for the radiation excitation.

Because of the discussed disadvantages (function of the one-sided vision barrier only in the case of ideal wind conditions not occurring in practice; requirement of a laborious and expensive detection process or presence of toxicologically hazardous substances in the aerosol cloud), neither of the two processes have hitherto been used in practice.

The invention solves the above-described problems in that there is produced a smoke one-sidedly transparent in the infrared spectral range with the features of the main claim. The solution is promoted by the means described in the subsidiary claims.

The producer of this smoke can carry out the detection of the opponent during the effective phase by means of suitable electronic sids (IR camera), whereas the sight not only in the visual but also in the infrared spectral range is removed from the opponent by irradiation of the LOS (line of sight).

The present invention uses a per se known smoke, impenetrable in the visual spectral range ($\lambda$=380 nm–780 nm) but transparent in the infrared spectral range ($\lambda$=780 nm–14.0 $\mu$m), from an aerosol with particle size of 0.1–5 $\mu$m which contains additionally produced scattered particles of a size of 10 to 100 $\mu$m. This two-component smoke is irradiated with an IR radiation source from the side of the smoke producer.

In FIG. 1 is to be seen a schematic illustration of the configuration. For both sides, the visual spectral range is covered by the first smoke component 6. The irradiation with electromagnetic waves in the IR range, which is made available either by a high capacity lamp with appropriate filters or by means of a pyrotechnic radiator 2, brings about, in the case of the second smoke component, the produced scattered particles 5, a characteristic forwards scattering 7 of the IR radiation in the direction of the opponent 9, whereas the scattering back portion of the IR radiation remains negligibly small.

The so resultant irradiation in the direction of the opponent 9 prevents the observation of the smoke producer 1 by means of an IR camera (typical detection wavelengths: 8.0–14.0 $\mu$m), whereas with the IR camera of the smoke producer 3, the observation of the opponent 9 is possible without problems.

In order to make clear the physical effects of the scattering of the IR radiation on the produced scattered particles 5 or the aerosol particles of the smoke components 6 covering in the visual spectral region, there were calculated radiation diagrams according to Mie's scattered light theory. In contradistinction to the Rayleigh scattering, in the case of knowledge of the optical and geometric properties of the scattered particles (complex refractive index m (λ); size parameter (x), this theory offers exact solutions for isotropic spheroidal scattered particles on any desired size.

Since most observation apparatus work in the wavelength range of 8.0–14.0 μm, as reference wavelength there was chosen λ=10.0 μm.

Figure 2:
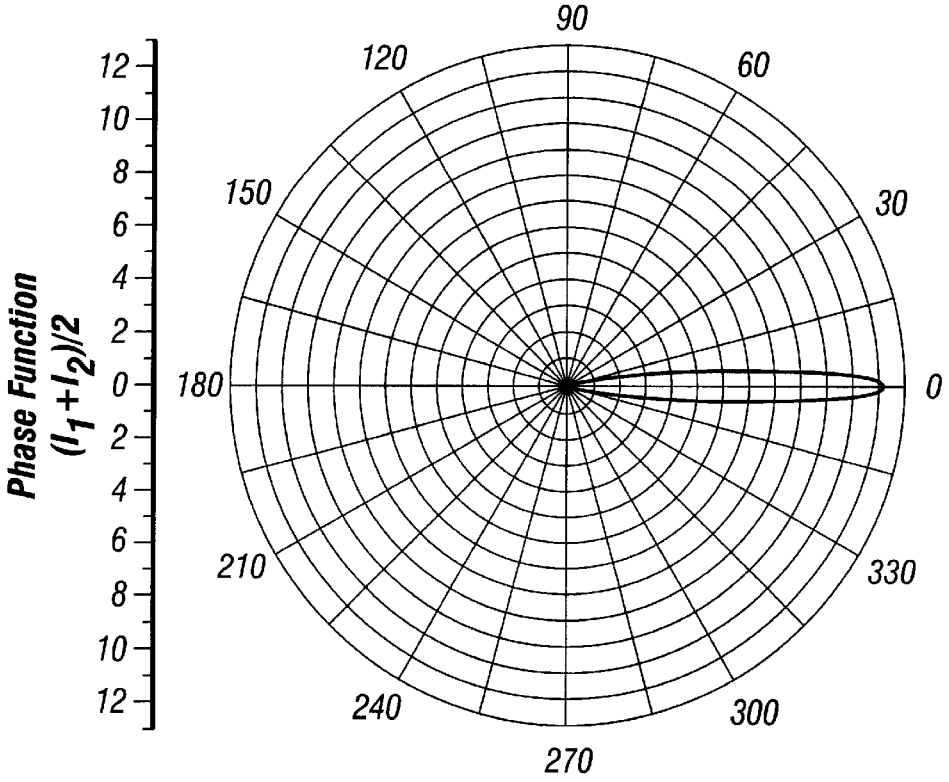

As example for the size-adapted scattering centres, there is used a spheroidal-shaped quartz particle with a radius of r=20 μm, whereby there is given the size parameter x of 12.57. The wavelength-dependent complex refractive index amounts to m(λ)=2.67–0.05 i for λ=10 μm. The quartz particle is present in the centre of the polar diagram in FIG. 2. The incident electro-magnetic wave coming from 180° is scattered. There is plotted the phase function P which is given as arithmetical middle value of the scattered light intensity l of the wave polarised vertically to the scattering plane and scattered light intensity $1_2$ of the wave polarised parallel to the scattering plane. One recognises the extremely marked forwards scattering and the negligible intensity of the lateral or backwardly scattered parts.

Therefore, scattered particles with a radius of 5–50 μm, i.e. a size of 10–100 μm, are especially suitable for such an anisotropic scattering of IR light. Since it is only a question of the scattering size and not of the chemical composition, solid particles were preferably used which are not toxic or irritating to the respiratory tract and are envirnmentally compatible. Quartz or glass meal, organic or inorganic salts are especially suitable.

In order to demonstrate the scattering effect of the IR radiation on the cloud Components l, i.e. the aerosol particles, there are used data of a typical aerosol particle of a smoke exclusively effective in the VIS region, consisting of red phosphorus, potassium nitrate and ammonium chloride for the scattered light analysis. After the burning, these form with the atmospheric moisture fine droplets which absorb the VIS light.

In the case of an assumed relative atmospheric moisture of 50%, the particle radius amounts ot 0.27 μm, i.e. the size parameter x amounts to 0.17. The complex refractive index for λ=10 amounts to m(λ)=1.63–0.69 i.

Figure 3:
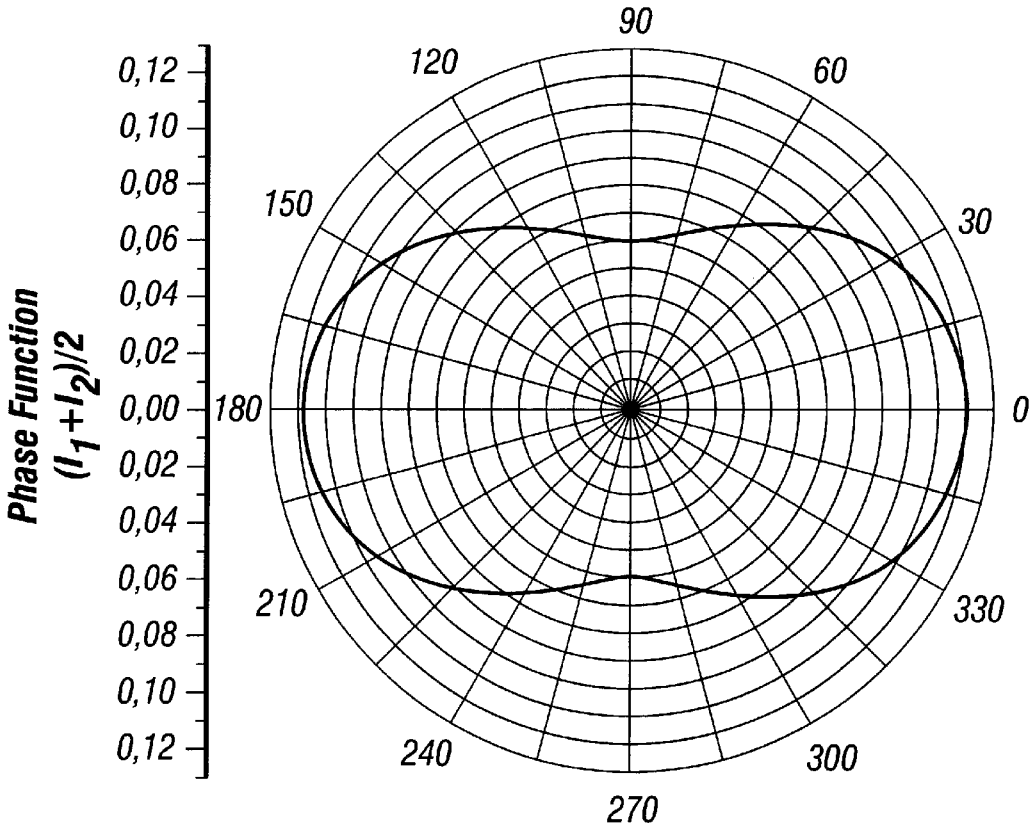

FIG. 3 shows the corresponding radiation diagram. There is present an almost isotropic intensity distribution. The intensity of the scattered electromagnetic wave is smaller by two powers of magnitude than in the case of the quartz particles, i.e. in the case of irradiation with an IR light source, no one or two-sided cross-fading occurs.

The action factor of the scattering $Q_{sca}$ is defined as the ratio of optically-effective particle surface, the scattering cross-section $C_{sca}$, to the geometric cross-sectional surface of the particle (in the case of spheroidal particles there applies $Q_{sca}=C_{sca}/\pi r^2$), is, in the case of the chosen wavelength of λ=10.0 μm, in the case of quartz particles greater by the factor $10^4$ than in the case of the aerosol particles of the smoke component l. Thus, the quartz particle produces an efficient and strongly directed scattering radiation of the incident electromagnetic wave in the direction of the opponent.

In order to achieve a complete camouflaging of the target object with regard to the heat image apparatus of the opponent, the difference of the radiation intensity of the target object and the radiation intensity of the background of the position of the detector must sink below a threshold value dependent upon the particular heat image apparatus. For the quantitative assessment of the detectability of the target object with the help of the IR camera of the opponent, one uses the contrast function c(r) dependent upon the distance r which is defined as $$c(r) = \frac{l_t(r) - l_b(r)}{l_b(r)} \tag{1}$$

whereby $l_t(r)$ represent the intensity of the target at the distance r and $l_b(r)$ the intensity of the background at the distance r. The contrast detectable without attenuation by atmosphere or artificial aerosols is given by:

$$c(O) = \frac{l_t(O) - l_b(O)}{l_b(O)} \tag{2}$$

The intensity of the target object at the distance r amounts to $$l_t(r)=l_t(O)\cdot T(r)+l_p(r) \tag{3}$$

whereby T(r) is the transmission at the distance r and $l_p(r)$ is the sum of the intensity radiated into the LOS (e.g. forwards scattering on aerosol particles). Correspondingly, for the intensity of the background at the distance r, there applies:

$$l_b(r)=l_b(O)\cdot T(r)+l_p(r) \tag{4}$$

With equation (3) and equation (4), for the contrast function c(r) there is given:

$$c(r) = \frac{c(O)}{l + [l_p(r)/l_b(O)][1/T(r)]} \tag{5}$$

Figure 4:
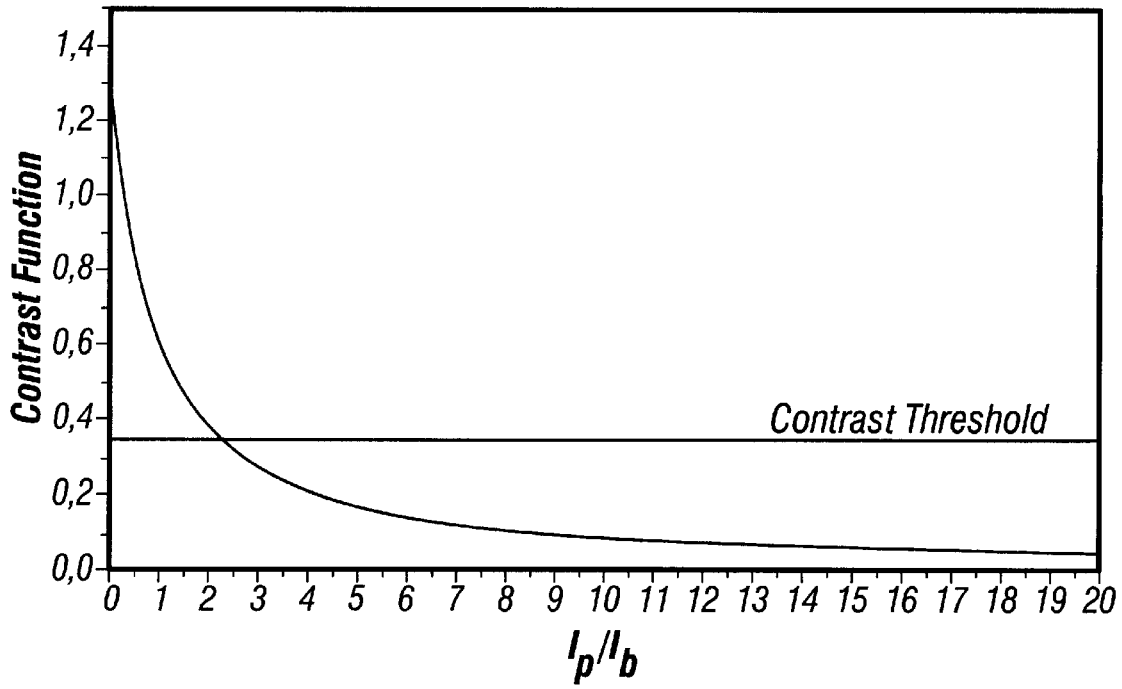

The effectiveness of the invention is to be made clear by the following Example:

For a typical scenario (distance mist producer—aerosol cloud: 40 m; distance aerosol cloud—opponent: 1000 m; depth of the aerosol cloud: 8 m) in FIG. 4 is illustrated the course of the contrast function c (equation 5) in dependence of the intensity relationship of the intensity $l_p$ beamed into the LOS to the background intensity $l_b(O)$. Not only the absorption by the atmosphere but also by the aerosol cloud was taken into account in the calculation of the transmission T(r).

The contrast threshold $C_{crit}$ in the case of which in the heat image apparatus the target object is no longer to be differentiated from the background amounts typically to 0.35, the contrast without attenuation amounts to 1.35.

As is to be seen, the contrast in the case of a relationship of $l_p/l_b(0)\lambda 2$ sinks below the threshold value of 0.35, i.e. the target object is no longer detectable by the heat image apparatus.

With the help of the Mie theory, there can be calculated the portion of the forwardly scattered radiation by the introduced scattered particles. In the case of the above-given relationships, of a concentration of the scattered particles of 0.3 g/m$^3$, of a wavelength of λ=10 μm and the assumption that $l_p$ is given by the forwards scattering of the scattered particles, the intensity of the IR radiation source of the smoke producer must be greater by the factor 30, for safety reasons by 30–100, than the intensity of the background in order to go the contrast threshold. If one specifies for the radiation intensity of the background $l_b$ in the wavelength range of 8.0–14.0 μm and an ambient temperature of 293 K a value of 40 W m$^{-2}$sr$^{-1}$, the intensity of the IR radiation source of the smoke producer in this wavelength range must reach a capacity of at least 1200–4000 W $m^{-2}sr^{-1}$ in order that the contrast in the heat image of the opponent falls under the contrast threshold and thus no detection of the target object is any longer possible.

LIST OF REFERENCES

1. smoke producer
2 IR radiation source
3 IR camera of the smoke producer
4 smoke projectile
5 size-adapted scattered particles
6 smoke components acting in the VIS range
7 forward scattering of the electromagnetic wave
8 IR camera of the opponent
9 opponent
10 backwards scattering of the electromagnetic wave

What is claimed is:

1. Process for the production of a smoke screen one-sidedly transparent in the infrared spectral range which is impermeable in the visible range characterised in that one a) produces a per se known pyrotechnic smoke screen strongly absorbing in the visual spectral range in the form of an aerosol and b) simultaneously introduces therein pyrotechnic scattered particles the size of which amounts to 10–100 $\mu$m and c) the two-component smoke is irradiated from the side of the smoke producer with an IR radiation source.

2. Process according to claim 1, characterised in that, in the case of the IR radiation source, it is a question either of a pyrotechnic emitter or of a strong-capacity lamp which is possibly equipped with appropriate filters.

3. Processing according to claim 1, characterised in that particle sizes and thus size parameters x of the produced scattered particles are so chosen that the effect of the strongly marked forward scattering is given either for the whole IR range or selected particle ranges within this wavelength range in the case of the IR radiation of the scattered particles described in claim 1.

4. Process according to claim 1, characterised in that the aerosol impermeable in the visual spectral range is produced by a pyrotechnic active mass based on ammonium chloride, potassium nitrate and lactose.

5. Process according to claim 1, characterised in that the produced scattered particles are quartz particles with a size of 20–50 $\mu$m.

* * * * *